US006457433B1

(12) United States Patent
Nagata

(10) Patent No.: US 6,457,433 B1
(45) Date of Patent: Oct. 1, 2002

(54) FUEL TANK FIXING STRUCTURE OF SMALL-SIZE BOAT

(75) Inventor: Tadaaki Nagata, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/967,930

(22) Filed: Oct. 2, 2001

(30) Foreign Application Priority Data

Oct. 2, 2000 (JP) ..... 2000-301721

(51) Int. Cl.[7] ..... B63B 17/00
(52) U.S. Cl. ..... 114/343; 114/55.5
(58) Field of Search ..... 114/343, 355, 114/55.5; 440/113, 111, 88; 248/637

(56) References Cited

U.S. PATENT DOCUMENTS 4,595,030 A * 6/1986 Yazaki ..... 137/203
5,423,279 A * 6/1995 Long ..... 114/343
6,244,915 B1 * 6/2001 Ozawa ..... 440/88

FOREIGN PATENT DOCUMENTS

JP A 4-201797 7/1992
JP A 5-16882 1/1993

* cited by examiner

*Primary Examiner*—Stephen Avila
(74) *Attorney, Agent, or Firm*—Birch, Stewart, Kolasch & Birch, LLP

(57) ABSTRACT

The present invention permits the positioning and support of a fuel tank in a stable state while preventing unnecessary stresses from being generated in the fuel tank. A tapered, single projecting portion for positioning is formed on either the bottom portion of an inner wall of a hull or the bottom of the fuel tank. A tapered, single depressed portion for positioning is fitted on the projecting portion, and is formed on the opposing bottom portion of the fuel tank or the inner wall of the hull, respectively. A space is formed between a peripheral wall of the fuel tank and the inner wall of the hull that permits contraction and expansion of the fuel tank.

16 Claims, 9 Drawing Sheets

FUEL TANK FIXING STRUCTURE OF SMALL-SIZE BOAT

CROSS-REFERENCES TO RELATED APPLICATIONS

This nonprovisional application claims priority under 35 U.S.C. § 119(a) on Patent Application No. 2000-301721, filed in Japan on Oct. 2, 2000, the entirety of which is herein incorporated by reference.

BACKGROUND OF THE INVENTION

FIELD OF THE INVENTION

The present invention relates to a fuel tank fixing structure for a small-size boat or craft, and more particularly to a fuel tank fixing structure for a saddle-type, small-sized boat or small craft.

DESCRIPTION OF THE BACKGROUND ART

As shown in FIG. 8(*a*), a first exemplary fuel tank fixing structure for a small-size boat is known in the background art in which a pair of tank supporting portions 3, 3 are provided on the bottom portion of an inner wall 2 of a hull 1. A fuel tank (hereinafter simply referred to as a tank) 4 is mounted on the tank supporting portions 3, 3, in a position in which the bottom portion of the tank 4 is sandwiched between the pair of tank supporting portions 3, 3. The tank 4 is fixed to the hull 1 by a belt 5. The belt 5 is fixed to one side of the hull and looped over the top surface of the tank 4 to the other side of the hull (see Japanese Unexamined Patent Publication No. 4-201797).

Further, as shown in FIG. 9, a second exemplary fuel tank fixing structure is known in the background art in which a tank 6 is formed in a shape adapted to the bottom portion of the inner wall 7 of a hull and is sandwiched, positioned and fixed by inner wall side surfaces 8, 8 opposing other (see Japanese Unexamined Patent Publication No. 5-16882).

The above-mentioned fuel tank fixing structures suffer from the following problems and drawbacks. First, the fuel tank is not always positioned and fixed in a stable state, as described hereinafter. Typically, a fuel tank does not always have a high dimensional accuracy after manufacture. For instance, where a fuel tank is manufactured from blow molding of synthetic resin, the dimensional accuracy inevitably becomes very low.

Under such conditions, for example, as shown in FIG. 8(*a*)–(*b*), in the structure in which the pair of tank supporting portions 3, 3 sandwich the tank 4, in the case a gap C is produced between the smaller tank 4' and the supporting portions 3, 3 where the tank 4 is smaller than a predetermined size. As seen in FIG. 8(*b*), the tank 4' cannot be accurately positioned and fixed in a stable state.

In contrast, as shown in FIG. 8(*c*), in the case where the tank 4 is larger than a predetermined size, the larger tank 4" is pressed by the supporting portions 3 by forces F producing undesirable stresses.

These problems are similarly presented in the structure shown in FIG. 9. In the case where the tank 6 is smaller than a predetermined size, a gap is produced between the small tank and the inner wall surfaces 8, 8. Accordingly, the tank cannot be positioned and fixed in a stable state. In contrast, in the case where the tank 6 is larger than a predetermined size, the larger tank 6 is pressed by the inner wall side surfaces 8 by forces producing undesirable stresses.

SUMMARY OF THE INVENTION

The present invention overcomes the shortcomings associated with the background art and achieves other advantages not realized by the background art.

An object of the present invention is to provide a fuel tank structure that permits stable attachment of a fuel tank to a small craft of vessel.

A further object of the present invention is to provide a fuel tank structure that permits stable attachment of the a fuel tank without incurring undesirable stresses in the surface of the fuel tank and surrounding structure.

These and other objects are accomplished by a fuel tank support structure for a small-size boat, the fuel tank support structure comprising a boat hull; a fuel tank mounted on a bottom portion of the hull; a tapered, single projecting portion for positioning formed on either an inner wall of the bottom portion of the hull or on a bottom portion of the fuel tank; a tapered, depressed portion for positioning fitted on the projecting portion and formed on either the bottom portion of the fuel tank or the inner wall of the bottom portion of the hull, the tapered, single projecting portion and the tapered, depressed portion matingly engaging in order to position the fuel tank with respect to the hull; and a space formed between a peripheral wall of the fuel tank and the inner wall of the hull.

Therefore, even if the fuel tank does not have a high dimensional accuracy, the tapered surface of the depressed portion or the projecting portion of the fuel tank is fitted on the tapered surface of the projecting portion or the depressed portion of the hull. The depressed portion or the projecting portion of the fuel tank is then positioned with respect to the projecting portion or the depressed portion of the hull in a stable state.

That is, even if the fuel tank is a little smaller or larger than a predetermined size, the fuel tank is positioned without experiencing undesirable play and unnecessary stresses in the fuel tank. Further, since the space is formed between the peripheral wall of the fuel tank and the inner wall of the hull, even if the fuel tank is a little larger than a predetermined size, no unnecessary stresses are generated in the fuel tank.

As described above, according to the fuel tank support structure for a small-size boat described hereinabove, the fuel tank can be positioned and fixed in a stable state and unnecessary stress are not generated in the fuel tank. Further, even if the fuel is put into the fuel tank to expand the fuel tank, it is possible to keep the fuel tank in a stable, reliably positioned state and to prevent any unnecessary stresses from being generated in the fuel tank.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

DETAILED DESCRIPTION OF THE PREFERRED EMBODIMENTS

Figure 1:
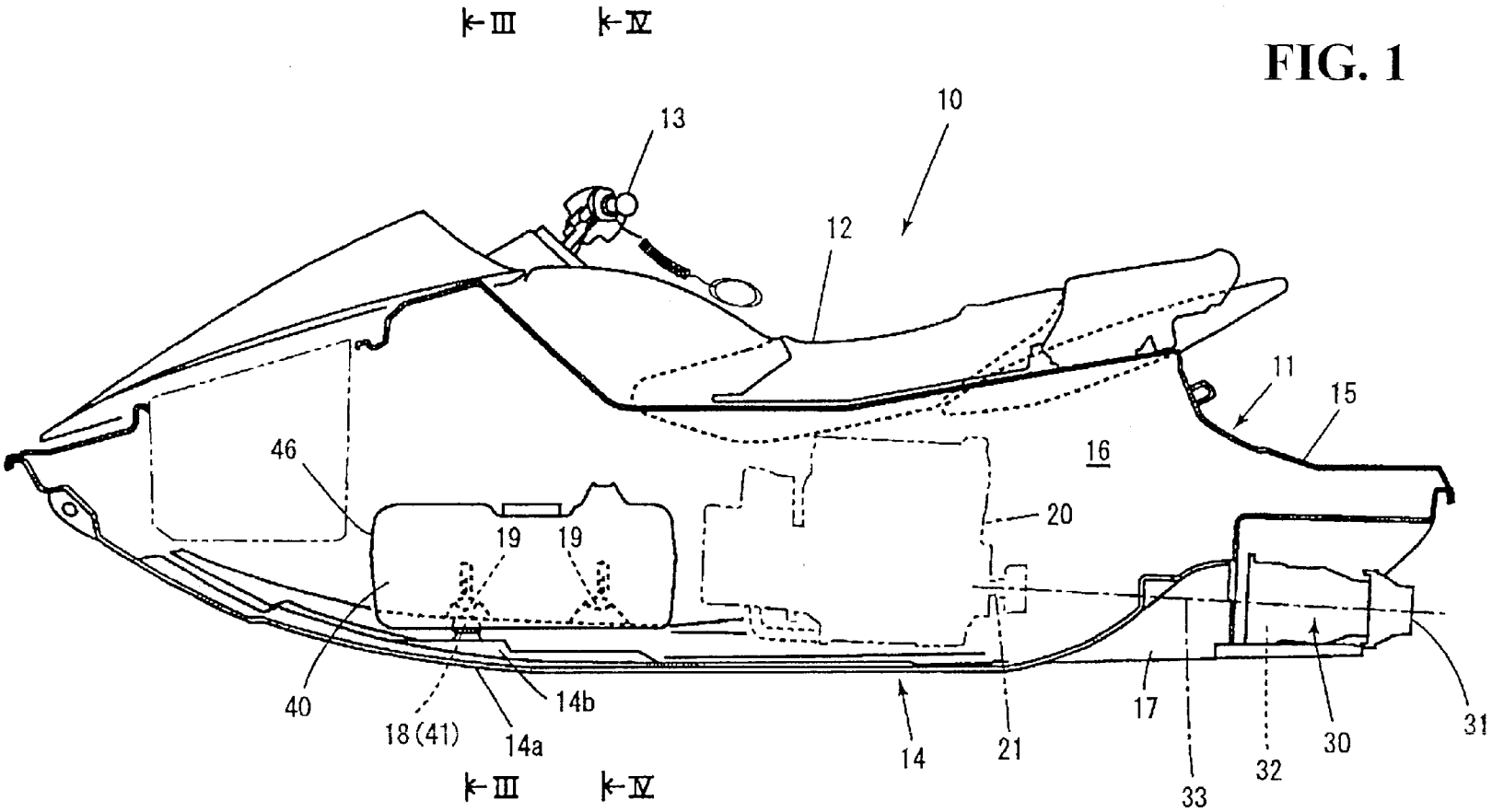
FIG. 1 is a partial side view of an exemplary small craft with a fuel tank fixing structure according to an embodiment of the present invention.
Figure 2:
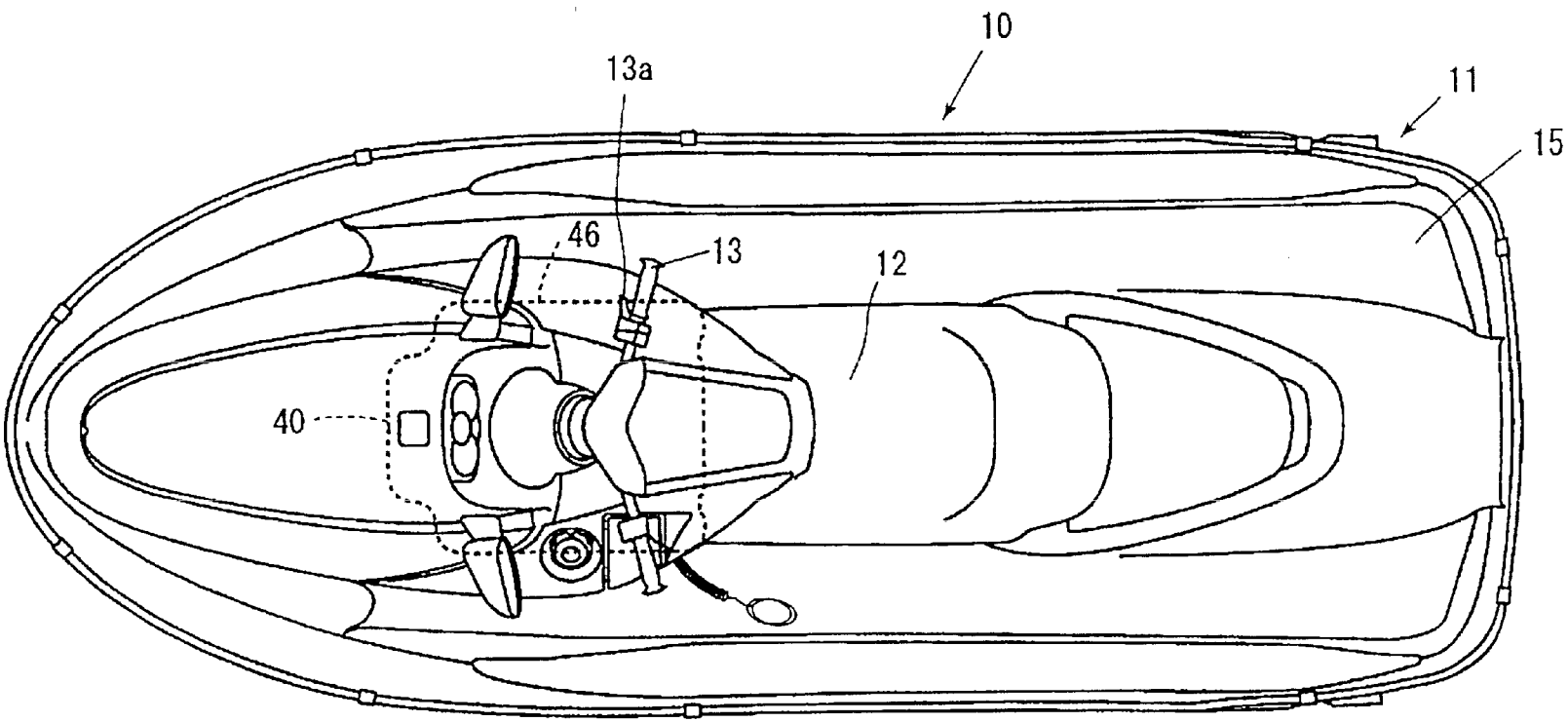
FIG. 2 is a plan view an exemplary small craft with a fuel tank fixing structure according to an embodiment of the present invention.
Figure 3:
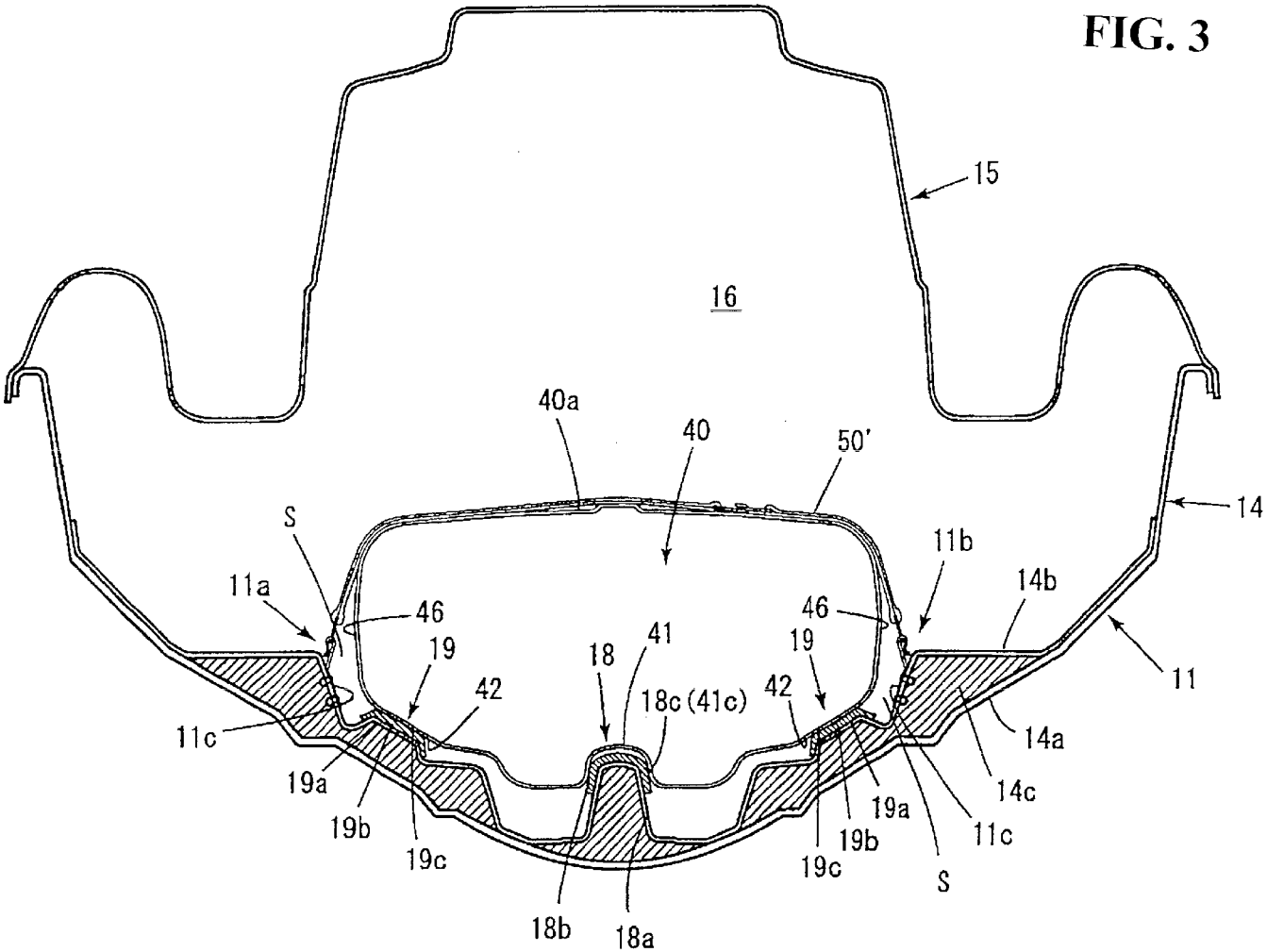
FIG. 3 is a cross-sectional view taken along line III—III in FIG. 1.
Figure 4:
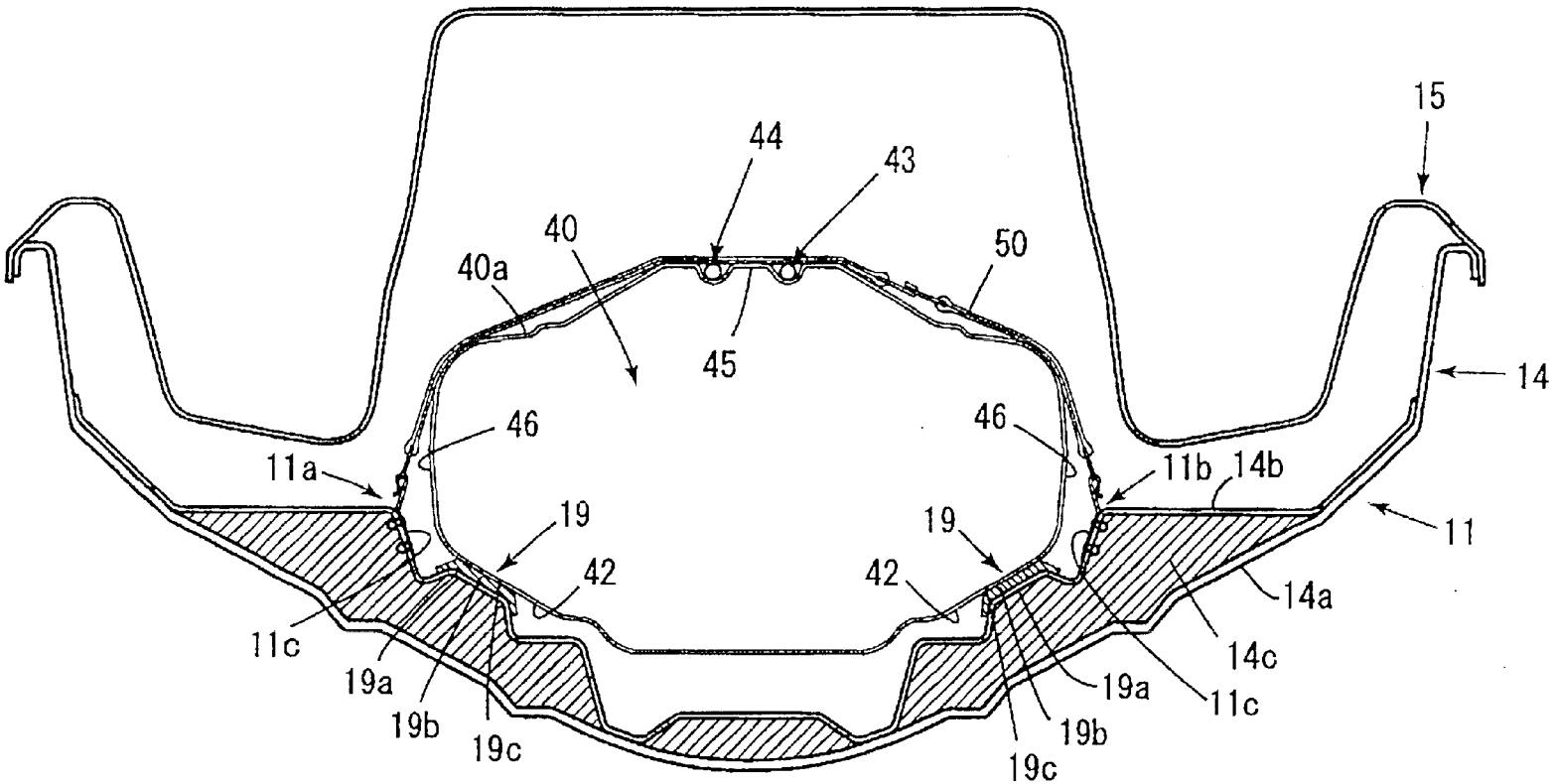
FIG. 4 is a partial cross-sectional view taken along line IV—IV in FIG. 1.
Figure 5:
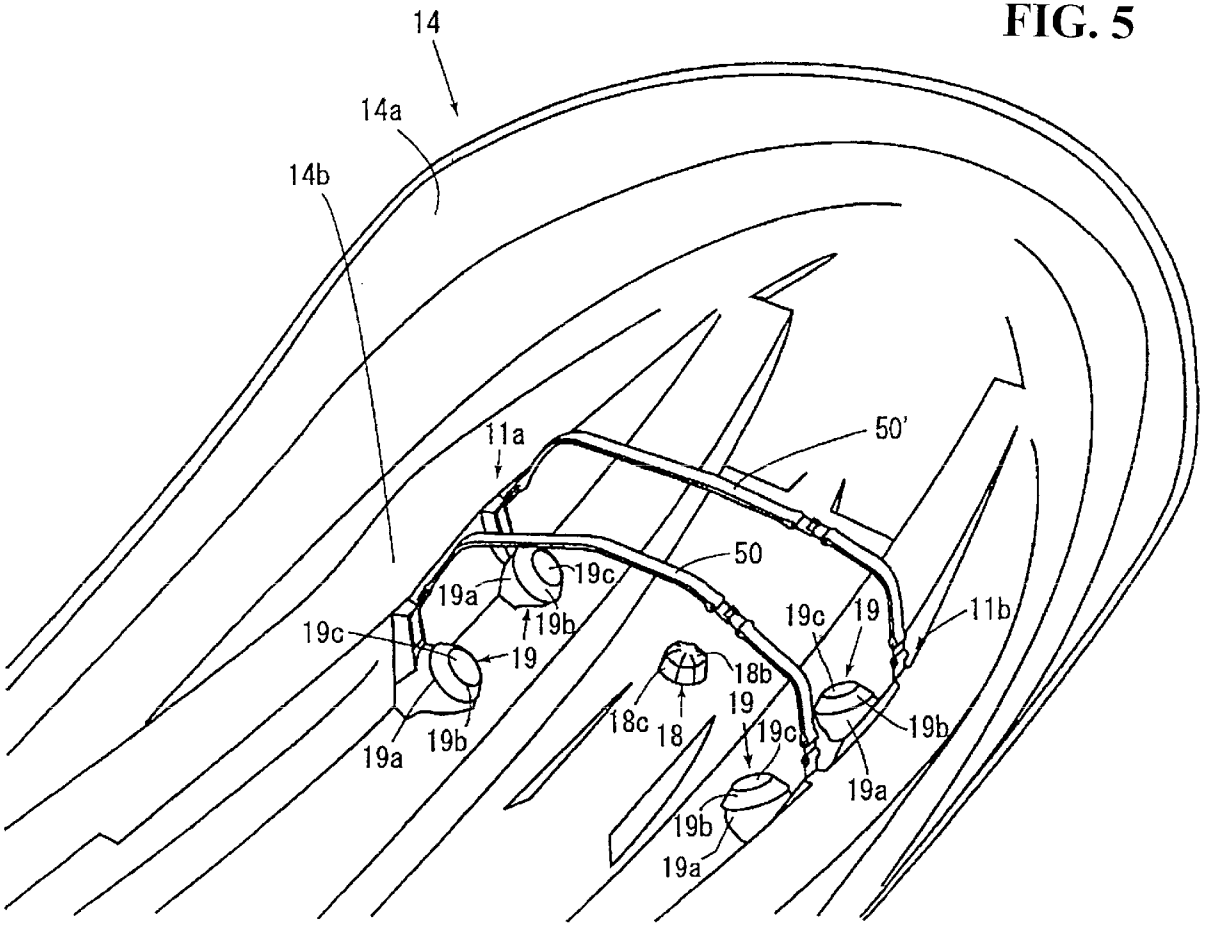
FIG. 5 is a perspective view of a portion of an inner wall of a hull where a fuel tank is mounted according to an embodiment of the present invention.
Figure 6:
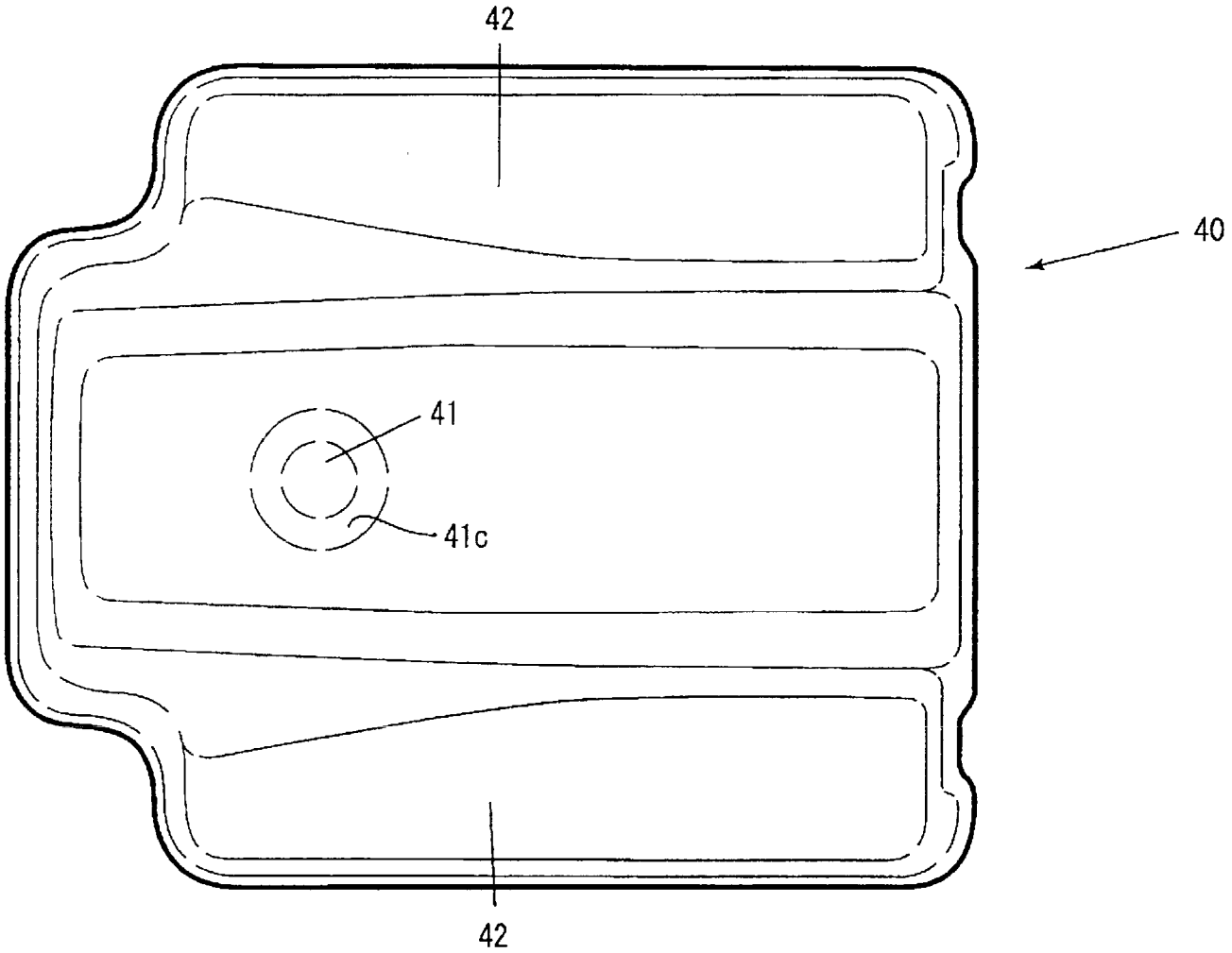
FIG. 6 is a bottom view of a fuel tank according to an embodiment of the present invention.
Figure 7A:
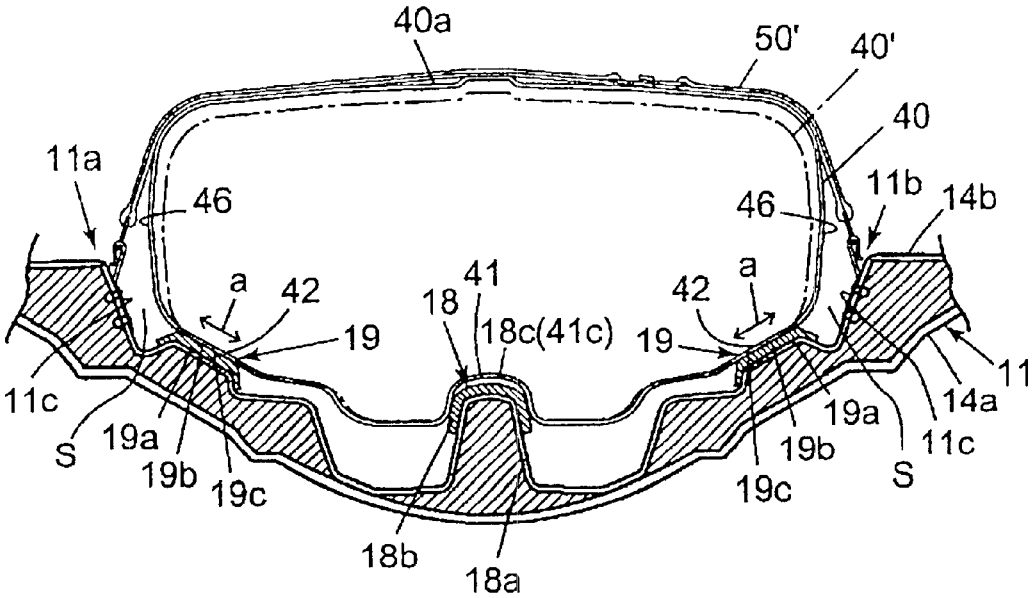
FIG. 7(*a*) and FIG. 7(*b*) are enlarged end views showing portions of the embodiments shown in FIG. 3.
Figure 7B:
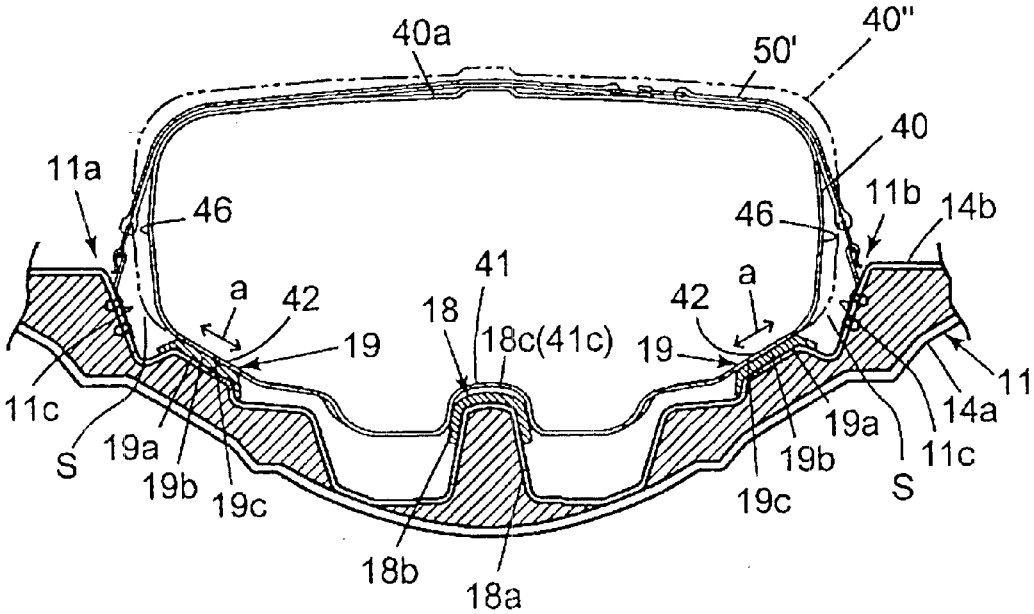
Figure 8A:
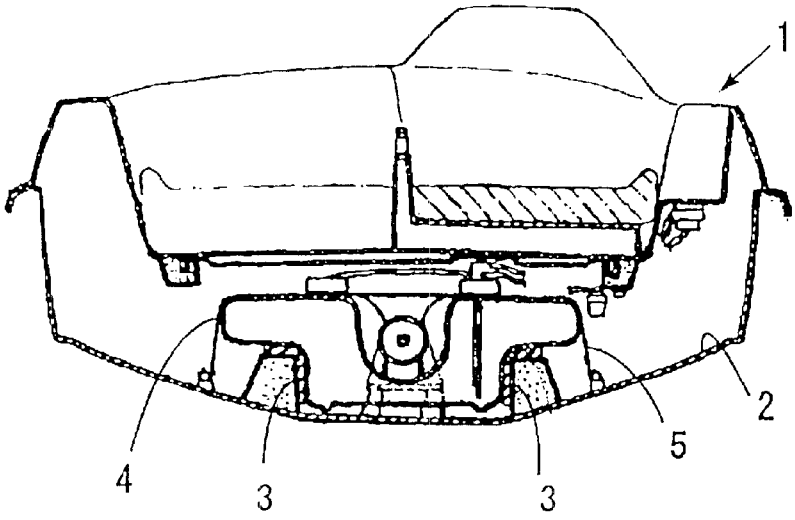
FIG. 8(*a*), FIG. 8(*b*) and FIG. 8(*c*) are end views of portions of a fuel tank support structure in a small boat hull according to the background art.
Figure 8B:
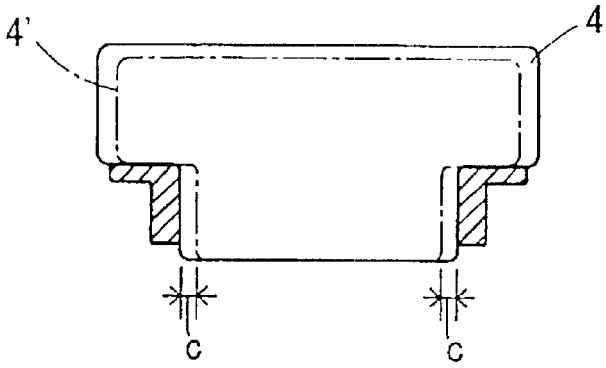
Figure 8C:
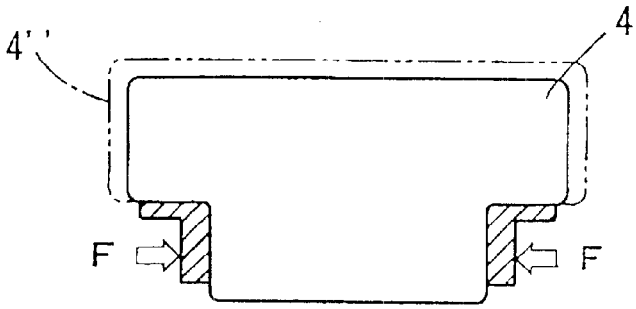
Figure 9:
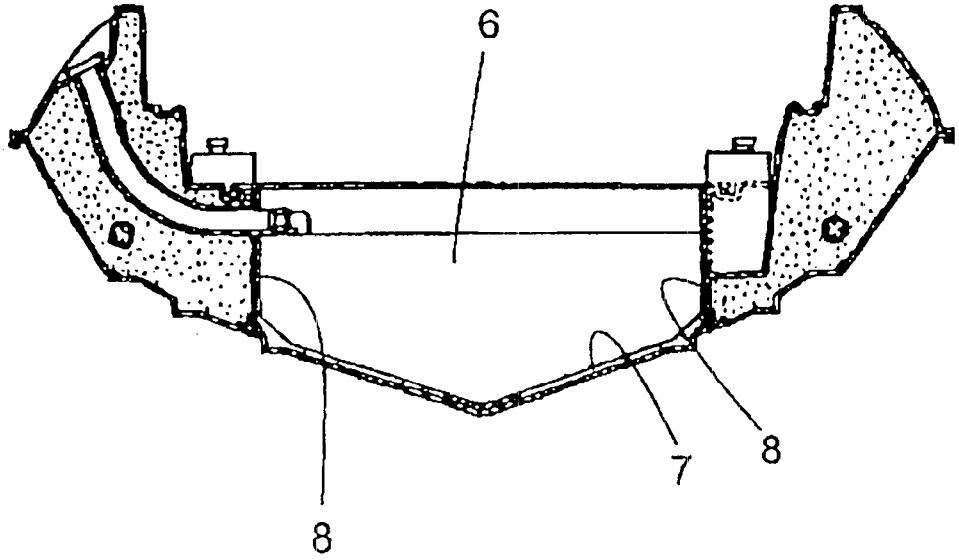
FIG. 9 is an end view showing an alternative fuel tank structure according to the background art.

The present invention will hereinafter be described with reference to the accompanying drawings. FIG. 1 is a partial side view of an exemplary small craft with a fuel tank fixing structure according to an embodiment of the present invention. FIG. 2 is a plan view an exemplary small craft with a fuel tank fixing structure according to an embodiment of the present invention. FIG. 3 is a cross-sectional view taken along line III—III in FIG. 1. FIG. 4 is a partial cross-sectional view taken along line IV—IV in FIG. 1. FIG. 5 is a perspective view of a portion of an inner wall of a hull where a fuel tank is mounted according to an embodiment of the present invention. FIG. 6 is a bottom view of a fuel tank according to an embodiment of the present invention. FIG. 7(*a*) and FIG. 7(*b*) are enlarged end views showing portions of the embodiments shown in FIG. 3.

As shown in these figures, a small-size boat 10 in a preferred embodiment is a saddle-type boat where the rider sits on a seat 12 mounted to a hull 11. The rider can drive the boat by gripping a steering handlebar 13 having a throttle lever 13*a*. One will appreciate that the present invention can be applied to a wide variety of boats, small craft and vessels well known in the related art, all collectively referred to hereinafter as a small-size boat 10.

The hull 11 has a floating structure in which a lower hull panel 14 is bonded to an upper hull panel 15 to form a space 16 therein. In the space 16, an engine 20 is mounted on the lower hull panel 14 and a jet pump 30 as a propelling unit driven by the engine 20 is provided at a rear portion of the lower hull panel 14.

The jet pump 30 has a flow passage 32 extending from a water intake port 17 made in the bottom of the boat to a jet nozzle 31 provided at the rear end of the hull. An impeller (not shown) is disposed in the flow passage 32 and a shaft 33 of the impeller is connected to the output shaft 21 of the engine 20. Accordingly, when the impeller is rotated by the engine 20, water taken from the water intake port 17 is jetted out from the nozzle 31 whereby the hull 11 is propelled.

The number of revolutions of the engine 20, which translates to a propelling force produced by the jet pump 30, is operatively controlled by turning the throttle lever 13*a* (see FIG. 2) of the operating handlebar 13. The nozzle 31 is connected to the operating handlebar 13 by an operating wire (not shown) and is turned by the operation of the handlebar 13 to change the direction of the boat.

A fuel tank 40 for supplying fuel to the engine 20 is mounted forward of the engine 20 on the bottom portion of an inner wall of the hull 11. The lower hull panel 14, as shown in FIG. 3 and FIG. 4, has a double hull structure, including an outer hull 14*a* and an inner hull 14*b*, at least at the portion where the fuel tank 40 is mounted. The fuel tank 40 is mounted on the inner hull 14*b*, e.g. on the bottom portion of the inner wall of the hull 11. In this area, the space between the outer hull 14*a* and the inner hull 14*b* is filled with a foaming material 14*c* to form a floating body.

As shown in FIG. 3 to FIG. 5, the inner hull 14*b* is provided with a single projecting portion for positioning 18 and four projecting supporting portions 19. The projecting portion 18 includes a base portion 18*a* integrally formed with the inner hull 14*b* and a cap 18*b* made of an elastic material (for example, rubber). The cap 18*b* is fixed to the base portion 18a so that it covers the base portion 18*a*. Similarly, the supporting portion 19 includes a base portion 19*a* integrally formed with the inner hull 14*b* and a cap 19*b* made of an elastic material (for example, rubber). The cap 19*b* is fixed to the base portion 19*a* so that it covers the base portion 19*a*.

The outer peripheral surface of the projecting portion for positioning 18 is formed with a tapered surface (circular truncated cone) 18*c*. On the other hand, as shown in FIG. 3 and FIG. 6, the bottom portion of the fuel tank 40 is formed with a single depressed portion for positioning 41, which is fitted on the projecting portion for positioning 18 of the hull side of the boat 10.

The inner peripheral surface of the depressed portion 41 is formed with a tapered surface (circular truncated cone) 41*c* which is formed in the same direction as the tapered surface 18*c* of the projecting portion for positioning 18 of the hull side. The fuel tank 40 is molded by blow molding synthetic resin (for example, polyethylene or the like). Portions 42, 42 of both the sides of the depressed portion for positioning 41 on the bottom surface are formed with slanting surfaces 42 nearly parallel to the slanting portion of the inner wall surface of the bottom portion of the hull (in the present preferred embodiment, top surface 19*c* of the cap 19*b* of the supporting portion 19). These slanting surfaces 42, 42 are supported movably in the direction of arrow (a) along the slanting surface 42 (as seen in FIG. 7(*a*)–7(*b*)) by the four projecting supporting portions 19 formed on the inner wall surface of the bottom portion of the hull 14.

The fuel tank 40 formed in the above manner, as shown mainly in FIG. 3 and FIG. 4, is mounted on the bottom portion of the hull 14 so that the depressed portion for positioning 41 is fitted on the projecting portion for positioning 18 on the hull side of the boat 10. In this mounting state, the depressed portion for positioning 41 is fitted on and positioned by the projecting portion for positioning 18, and the slanting surfaces 42, 42 of both sides are supported by the four supporting portions 19 of the hull side.

Further, as shown in FIG. 3 to FIG. 5, the fuel tank 40 is fixed to the hull 11 by an elastic belt (50, 50') looped from one side 11*a* of the hull 11 to the other side 11*b* of the hull 11 along the top surface 40*a* of the fuel tank 40. In FIG. 3, two elastic belts are used and designated by symbols 50, 50', but the number of the belts may be suitably selected and varied as desired. The number of the belts incorporated may be one, two or even three or more.

As shown in FIG. 4, a supporting portion 45 for supporting a fuel supply hose 43 communicating with the fuel tank 40, and a fuel return hose 44, is integrally formed on the top surface 40*a* of the fuel tank 40. The fuel supply hose 43 and the fuel return hose 44 are fixed to the fuel tank 40 by the supporting portion 45 and the elastic belt 50.

A space S is formed, in the plan view, between the peripheral wall 46 of the fuel tank 40 mounted in this manner and the inner wall 11*c* of the hull 11 (see FIG. 3 and FIG. 4). The fuel tank fixing structure described above can produce the following operations and effects.

The single projecting portion for positioning 18 with the taper 18*c* is formed on the bottom portion of the inner wall of the hull 11. The single depressed portion for positioning 41, which is fitted on the projecting portion 18 and has the taper 41*c* in the same direction as the projecting portion 18, is formed on the bottom of the fuel tank 40 mounted on the bottom portion. The space S is formed between the peripheral wall 46 of the fuel tank 40 and the inner wall 11*c* of the hull 11. Therefore, when the fuel tank 40 is mounted on the bottom portion of the inner wall of the hull 11, the single depressed portion for positioning 41 formed on the bottom portion of the fuel tank 40 is fitted on the single projecting portion 18, whereby the fuel tank 40 is positioned on the bottom portion of the inner wall of the hull 11.

Since the tapers 18*c*, 41*c* are formed in the same direction on the projecting portion 18 of the bottom portion side of the hull 11 and on the depressed portion 41 of the fuel tank 40, the depressed portion 41 is fitted on the projecting portion for positioning 18 by putting the tapered surface 18*c* into contact with the tapered surface 41*c*.

Therefore, even if the fuel tank 40 does not have a high dimensional accuracy, the tapered surface 41*c* of the fuel tank 40 is fitted on the tapered surface 18*c* of the projecting portion 18 of the hull 11, whereby the depressed portion 41 of the fuel tank 40 is stably fitted on and positioned with respect to the projecting portion 18 of the hull 11.

That is, even if the fuel tank 40 is a little smaller than a predetermined size (shown by a solid line 40), as shown by a single dot and dash line 40' in FIG. 7(*a*), or a little larger than the predetermined size, as shown by a double dots and dash line 40" in FIG. 7(*b*), the fuel tank 40 is fitted without demonstrating any play at the positioning portion. Accordingly, no unnecessary stresses are generated therein.

Further, since the space S is formed, even if the fuel tank 40 is a little larger than a predetermined size, as shown by a double dots and dash line 40" in FIG. 7(*b*), the outer peripheral wall of the fuel tank 40 can deflect toward the space S and upward. Therefore, unnecessary stresses are not generated in the fuel tank 40.

Further, even if the fuel tank 40 is mounted on the hull 11 and then fuel is put into the fuel tank 40 to expand the fuel tank 40, the tapered depressed portion 41 is fitted on the tapered projecting portion 18 and hence the tank is kept in the stable positioning state and no unnecessary stress is generated in the fuel tank 40.

At least one part (42) of both sides of the depressed portion 41 on the bottom surface of the fuel tank 40 is formed with slanting surfaces 42, 42 slanting nearly parallel to the slanting portion 19*c* of the inner wall of the bottom portion of the hull. These slanting surfaces 42, 42 are supported movably in the direction along the arrow (a) in FIG. 7 by the projecting supporting portion 19 formed on the inner wall of the bottom portion of the hull 11.

For this reason, even if the fuel tank 40 is a little smaller or larger than a predetermined size, as shown in FIG. 7(*a*), (*b*), the slanting surfaces 42, 42 are fitted on the supporting portion 19, which can position and fix the fuel tank 40 in the more stable state and further surely prevent unnecessary stresses from being generated in the fuel tank 40.

Still further, even if the fuel tank 40 is mounted on the hull 11, and fuel is put into the fuel tank 40 to expand the fuel tank 40, the slanting surfaces 42, 42 formed nearly parallel to the slanting portion 19*c* of the inner wall of the bottom portion of the hull can be moved in the direction along the slanting surface 42 in the direction of arrow (a) in FIG. 7. Therefore, this can further prevent unnecessary stresses from being generated in the fuel tank 40.

Since the fuel tank 40 is molded by blowing synthetic resin, the fuel tank 40 can be formed more easily. Although the fuel tank molded by blowing synthetic resin has a low dimensional accuracy, the fuel tank 40 of the present invention can be positioned and fixed in the stable state and no unnecessary stresses are generated in the fuel tank 40. Further, even if the fuel tank 40 is mounted on the hull 11 and then fuel is put into the fuel tank 40 to expand the fuel tank 40, it is possible to keep the fuel tank 40 in a stable and fixed position, and to prevent unnecessary stresses from being generated in the fuel tank 40. That is, the fuel tank fixing structure like the present preferred embodiment is particularly effective in the case where the fuel tank 40 is blow molded with synthetic resin.

The fuel tank 40 is fixed to the hull 11 by the elastic belts 50, 50' looped from one side 11*a* of the hull 11 to the other side 11*b* of the hull 11 over the top surface 40*a* of the fuel tank 40. Therefore, even if the fuel tank 40 is a little smaller or larger than the predetermined size, it is possible to position and fix the fuel tank 40 in the more stable state and to prevent unnecessary stresses from being generated in the fuel tank 40 by the operations and effects described in the aforementioned paragraphs and by the elastic action of the elastic belts.

The supporting portion 45 for the fuel supply hose 43 and the fuel return hose 44, both of which communicate with the fuel tank 40, are provided on the top surface of the fuel tank 40. The fuel supply hose 43 and the fuel return hose 44 are fixed to the top surface of the fuel tank 40 by the supporting portion 45 and the elastic belt 50. Therefore, it is possible to position and fix the fuel supply hose 43 and the fuel return hose 44 with the fuel tank 40 in the stable state.

It will be obvious that the aforementioned embodiments can be varied in many ways. For example, although the projecting portion for positioning 18 is formed on the bottom portion of the inner wall of the hull 11, and the depressed portion for positioning 41 is formed on the bottom portion of the fuel tank 40 in the above preferred embodiment, the depressed portion for positioning 41 may be formed on the bottom portion of the inner wall of the hull 11 and the projecting portion for positioning 18 may be formed on the bottom portion of the fuel tank 40.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel tank support structure for a small-size boat, the fuel tank support structure comprising:

a boat hull;

a fuel tank mounted on a bottom portion of the hull;

a tapered, single projecting portion for positioning formed on either an inner wall of the bottom portion of the hull or on a bottom portion of the fuel tank;

a tapered, depressed portion for positioning fitted on the projecting portion and formed on either the bottom portion of the fuel tank or the inner wall of the bottom portion of the hull, said tapered, single projecting portion and said tapered, depressed portion matingly engaging in order to position said fuel tank with respect to said hull; and a space formed between a peripheral wall of the fuel tank and the inner wall of the hull.

2. The fuel tank support structure according to claim 1, wherein at least a part of the tapered, projecting portion has a slanted surface, and the tapered, depressed portion has a slanted surface, each slanted surface having angled sides nearly parallel to each other.

3. The fuel tank support structure according to claim 2, further comprising:

a plurality of slanting portions provided on the inner wall of the hull and on the bottom of the fuel tank, the plurality of slanting portions on the inner wall nearly in parallel with the slanting surfaces of the fuel tank; and a pair of fuel tank projecting supporting portions provided on the inner wall of the bottom portion of the hull, said fuel tank projecting supporting portions both supporting said fuel tank and permitting movement of said fuel tank with respect to the inner wall of the hull.

4. The fuel tank support structure according to claim 1, wherein the fuel tank is formed from blow molded, synthetic resin.

5. The fuel tank support structure according to claim 2, wherein the fuel tank is formed from blow molded, synthetic resin.

6. The fuel tank support structure according to claim 3, wherein the fuel tank is formed from blow molded, synthetic resin.

7. The fuel tank support structure according to claim 1, further comprising:

the hull including a first side and a second side;

the fuel tank including a top surface;

an elastic belt, wherein the fuel tank is fixed to the hull by an elastic belt looped from the first side of the hull to the second side of the hull over the top surface of the fuel tank.

8. The fuel tank support structure according to claim 2, further comprising:

the hull including a first side and a second side;

the fuel tank including a top surface;

an elastic belt, wherein the fuel tank is fixed to the hull by an elastic belt looped from the first side of the hull to the second side of the hull over the top surface of the fuel tank.

9. The fuel tank support structure according to claim 3, further comprising:

the hull including a first side and a second side;

the fuel tank including a top surface;

an elastic belt, wherein the fuel tank is fixed to the hull by an elastic belt looped from the first side of the hull to the second side of the hull over the top surface of the fuel tank.

10. The fuel tank support structure according to claim 7, further comprising:

a fuel hose communicating with the fuel tank provided on the top surface of the fuel tank; and a support portion for supporting a fuel hose communicating with the fuel tank is provided on the top surface of the fuel tank, wherein the fuel hose is fixed to the fuel tank by the support portion and the elastic belt.

11. The fuel tank support structure according to claim 9, further comprising:

a fuel hose communicating with the fuel tank provided on the top surface of the fuel tank; and a support portion for supporting a fuel hose communicating with the fuel tank is provided on the top surface of the fuel tank, wherein the fuel hose is fixed to the fuel tank by the support portion and the elastic belt.

12. The fuel tank support structure according to claim 1, wherein the tapered, projecting portion includes a base portion integrally formed with the inner hull and an elastic cap fixed to and covering the base portion.

13. The fuel tank support structure according to claim 11, wherein the tapered, projecting portion includes a base portion integrally formed with the inner hull and an elastic cap fixed to and covering the base portion.

14. The fuel tank support structure according to claim 3, wherein each of the fuel tank projecting supporting portions includes a base portion integrally formed with the inner hull and an elastic cap fixed to and covering the base portion.

15. The fuel tank support structure according to claim 11, wherein each of the fuel tank projecting supporting portions includes a base portion integrally formed with the inner hull and an elastic cap fixed to and covering the base portion.

16. The fuel tank support structure according to claim 1, wherein the boat hull is a double hull structure including an outer hull and an inner hull, said inner hull including said inner wall of the hull, and a space formed between said outer hull and said inner hull is filled with a foaming material.

* * * * *